US005570579A

United States Patent [19]

Larjola

[11] Patent Number: 5,570,579

[45] Date of Patent: Nov. 5, 1996

[54] METHOD AND APPARATUS FOR IMPROVING THE EFFICIENCY OF A SMALL-SIZE POWER PLANT BASED ON THE ORC PROCESS

[75] Inventor: Jaakko Larjola, Mäntyharju, Finland

[73] Assignee: High Speed Tech Oy Ltd., Tampere, Finland

[21] Appl. No.: 178,295

[22] PCT Filed: Jul. 1, 1992

[86] PCT No.: PCT/FI92/00204

§ 371 Date: Jan. 11, 1994

§ 102(e) Date: Jan. 11, 1994

[87] PCT Pub. No.: WO93/01397

PCT Pub. Date: Jan. 21, 1993

[30] Foreign Application Priority Data

Jul. 11, 1991 [FI] Finland ..... 913367

[51] Int. Cl.[6] ..... F01K 25/00

[52] U.S. Cl. ..... 60/651; 60/653; 60/671; 60/679

[58] Field of Search ..... 60/651, 653, 671, 60/679; 290/52, 4 R, 54

[56] References Cited

U.S. PATENT DOCUMENTS

| | | | |
|---|---|---|---|
| 3,234,734 | 2/1966 | Buss et al. | 60/651 |
| 3,277,651 | 10/1966 | Augsburger | 60/679 |
| 3,376,706 | 4/1968 | Angelino | 60/651 |
| 3,795,816 | 3/1974 | Frei | 290/52 |
| 4,299,561 | 11/1981 | Stokes | 432/28 |
| 5,024,057 | 6/1991 | Kawamura | 290/52 |
| 5,136,854 | 8/1992 | Abdelmalek | 60/651 |
| 5,329,771 | 7/1994 | Kytömäki et al. | 60/657 |

FOREIGN PATENT DOCUMENTS

| | | | |
|---|---|---|---|
| 0003264 | 8/1979 | European Pat. Off. . | |
| 0045179 | 2/1982 | European Pat. Off. | 60/671 |
| 0372864 | 6/1990 | European Pat. Off. . | |
| 2686376 | 7/1993 | France | 290/52 |
| 2511842 | 9/1975 | Germany . | |
| 3915618 | 11/1989 | Germany . | |

OTHER PUBLICATIONS

Van Wylen & Sonntag, "Fundamentals of Classical Thermodynamics" SI, 3d., John Wiley & Sons, NY, © 1985.

*Primary Examiner*—Leonard E. Heyman
*Attorney, Agent, or Firm*—Pollock, Vande Sande & Priddy

[57] ABSTRACT

A method is provided for improving the efficiency of a small-size power plant based on an ORC process. The plant comprises at least one energy converter unit, with a power range below 500 kW, and at least one burner for combustion of fuel for producing energy for the energy converter unit. The energy converter unit includes a high-speed machine which comprises first and second turbines and a generator mounted on a common rotor having rotational speed exceeding 8000 rpm. An ORC medium is vaporized in a vaporizer by utilizing energy derived from the combustion of the fuel in the burner, and then expanded in the first turbine of the high-speed machine to produce electric energy. The ORC medium leaving the first turbine is then reheated by a superheater of the vaporizer utilizing energy derived from the combustion of the fuel in the burner. The reheated ORC medium is expanded in the second turbine of the high-speed machine to produce electric energy and led the second turbine a cooling arrangement for condensing the same. The method also includes leading the fluid ORC medium to the vaporizer in the first step through a pre-heater forming a part of the cooling arrangement where it is preheated by the ORC medium coming from the second turbine of the high-speed machine.

9 Claims, 4 Drawing Sheets

METHOD AND APPARATUS FOR IMPROVING THE EFFICIENCY OF A SMALL-SIZE POWER PLANT BASED ON THE ORC PROCESS

FIELD OF THE INVENTION

The present invention relates to a method for improving the efficiency of a small-size power plant preferably based on a closed, i.e. hermetic Organic Rankine Cycle (ORC) process, whereby the ORC medium, such as fluorinated hydrocarbons (sold under the trade name FREON), toluene or the like, is vaporized in a vaporizer, condensated in a cooler and returned by a feeding device back to the vaporizer, whereby the small-size power plant, such as an energy converter unit or several of the same comprises a high-speed machine which is formed of at least a turbine and a generator changing the form of energy and mounted on a common rotor.

BACKGROUND OF THE INVENTION

The small-size power plant based on the ORC process was developed particularly for reclamation of the heat lost from different heat-producing processes or machines, which cannot be used as such by heat transfer means or the like, due to the temperature of the lost heat in question or the conditions of the environment. In a small-size power plant, waste energy is usually converted by means of a turbine and a generator to electricity which can be easily utilized for different purposes. If high efficiency of the small-size power plant is achieved, the plant can also be used for small-scale energy production using fuel such as wood chips burned for this purpose.

It can be shown thermodynamically that converting such energy is best performed by a Rankine or ORC process based on circulation of an organic medium. The organic medium has a relatively small vaporization heat as compared with, for example water, the drop of its specific enthalpy in the turbine is small and the mass flow rate in relation to the output is high, whereby it is possible to achieve a high turbine efficiency even at small output rates.

A hermetic or fully closed circuit process has the advantage that there are no leaks and the process is thus reliable and durable in operation. The utilization of high-speed technology, whereby the turbine is directly coupled with a generator rotating at the same speed and thus producing high-frequency current, has made it possible to further simplify the process in a way that e.g. a separate reduction gear required by conventional processes as well as shaft inlets are not needed.

A hermetic energy converter unit of this kind, operating on high-speed technology and based on the ORC process, is known from the publication FI-66234, according to which the bearing of the rotor of the high-speed machine is carried out by an organic circulating medium, wherein the circulating medium is in a gaseous state. A previous patent application by the Applicant, FI-904720, discloses a method for securing the lubrication of the bearings in a hermetic high-speed machine.

The output of a single energy converter unit being used for applications in this connection is below 500 kW mainly because of constructional reasons. Naturally the total output of a small-size power plant may be significantly bigger by combining several energy converter units. The speed of rotation may vary considerably, in customary applications being generally over 8000 rpm, in power range from 200 kW to 400 kW most suitably between 18000 and 12000 rpm.

The process efficiency rates of small-size power plants are typically within the range of 10–21% depending on the size of the power plant, the circulating medium, the temperature of the incoming waste heat, and other similar factors, whereby the maximum efficiency that can normally be attained by an ORC process is 20–24%.

It is generally known that the efficiency of an aqueous steam process can be raised by reheating, because the average temperature of incoming heat is raised as explained for example in the Finnish publication Tekniikan K äsikirja II, p. 630. However, reheating is commonly used in relatively large power plants only, because two turbines operating at a different pressure level are needed. Similarly, a method is known from the publication mentioned above for reducing the superheating of the superheated aqueous steam by spraying water in it. Also this arrangement is utilized only in relatively large power plants.

The present invention make it possible to attain a significant improvement in plant efficiency as compared with that of a normal small-size power plant based on the ORC process. For achieving this aim, the method of the invention is mainly characterized in that, in the ORC the, ORC medium is intercooled by an intercooler, substantially in connection with the turbine and/or reheated in the vaporizer, wherein, first and second expansion phases in the turbine are carried out by the first and second turbine wheels of the turbine mounted on the rotor of the high-speed machine.

The most important advantages of the method of the invention are its simplicity and reliability of operation, whereby the method enables the application of a conventional technique, in connection with the ORC proces for improving the efficiency of a small-size power plant operating on high-speed technology.

Using the apparatus according to the invention, it is possible to utilize the ORC process in a simple and efficient manner in a small-size power plant giving a significantly better output than the present solutions. The efficiency is raised by means of the apparatus of the invention, whereby the net output of the small-size power plant is increased. Consequently, despite the capital investment in the additional arrangements required by the method, the total operating costs of the apparatus are significantly lower than with present solutions.

BRIEF DESCRIPTION OF THE DRAWINGS

In the following description, the invention is illustrated in detail with reference to the accompanying drawings, in which.

DESCRIPTION OF THE PREFERRED EMBODIMENTS

Figure 1:
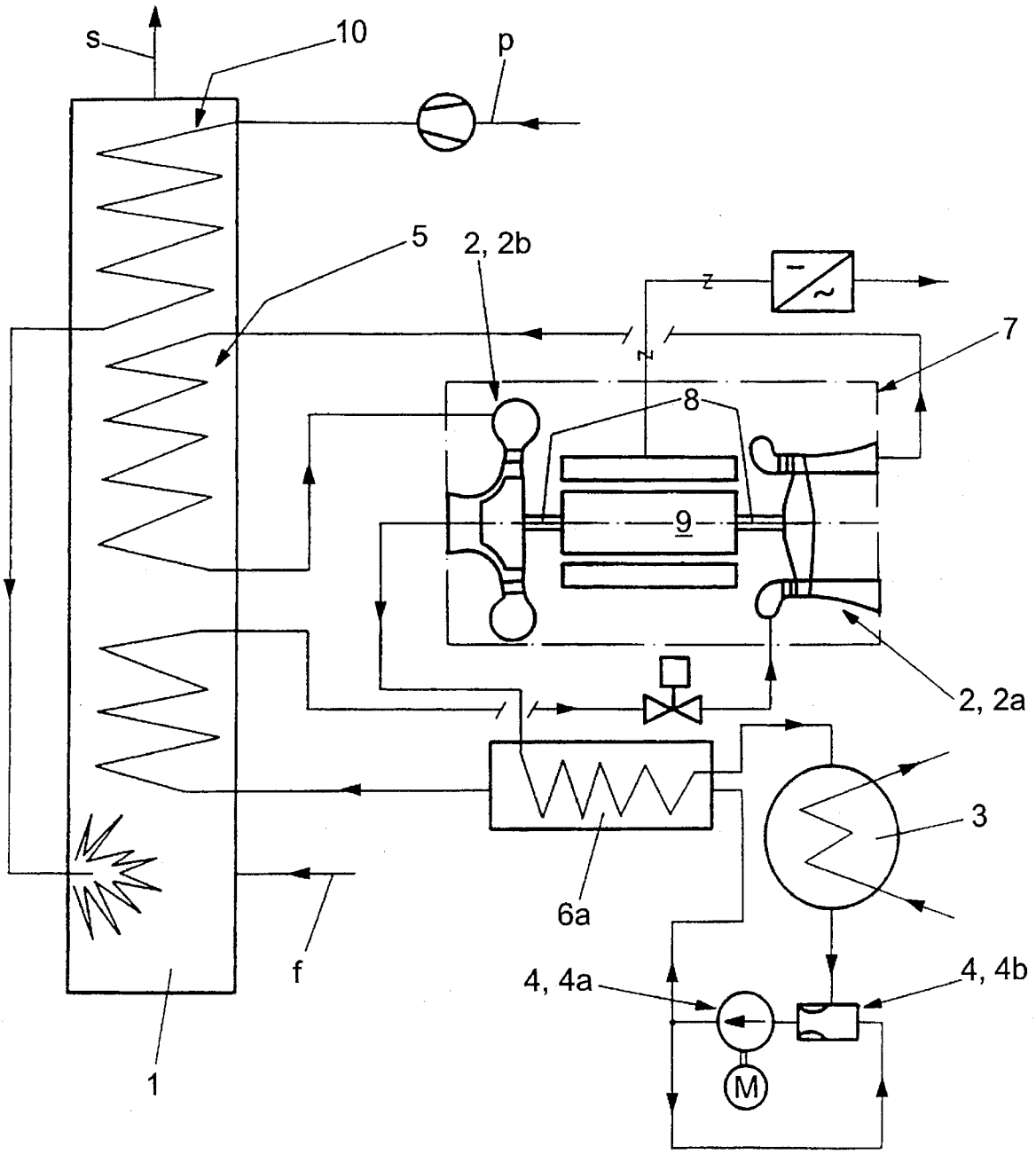
FIG. 1 shows an operating chart of the apparatus applying the method in principle.

This invention relates to a method for improving the efficiency of a small-size power plant based on an Organic Rankine Cycle (ORC) process. In a preferably closed, that is hermetic ORC process, the ORC medium, such as fluorinated hydrocarbons (sold under the trade name FREON), toluene or the like, is vaporized in a vaporizer 1, expanded in a turbine 2, condensated in a cooler 3 and returned by a feeding device 4 back to the vaporizer 1. The small-size power plant, such as an energy converter unit, comprises a high-speed machine 7 which is formed of at least a turbine 2 and a generator 9 changing the form of energy which are mounted on a common rotor 8. According to the invention, ORC medium is intercooled by an intercooler 6*b*, 6*c* substantially in connection with turbine 2 and/or reheated by a superheater 5 in the vaporizer 1, whereby the first and second expansion phase in the turbine 2 are carried out by the first 2*a* and second 2*b* turbine wheels of turbine 2 mounted on the rotor 8 of the high-speed machine 7.

The operating chart shown in FIG. 1 illustrates an advantageous embodiment of the apparatus applying the method, wherein the ORC process is utilized in a small-size power plant supplied with fuel F, such as wood chips. The first expansion phase in turbine 2 is carried out by the first turbine wheel 2*a* and the second expansion phase by the second turbine wheel 2*b* mounted on the rotor 8 of the high-speed machine 7. The reheater is formed of a superheater 5 comprising a heat exchanger in the vaporizer 1.

Figure 3:
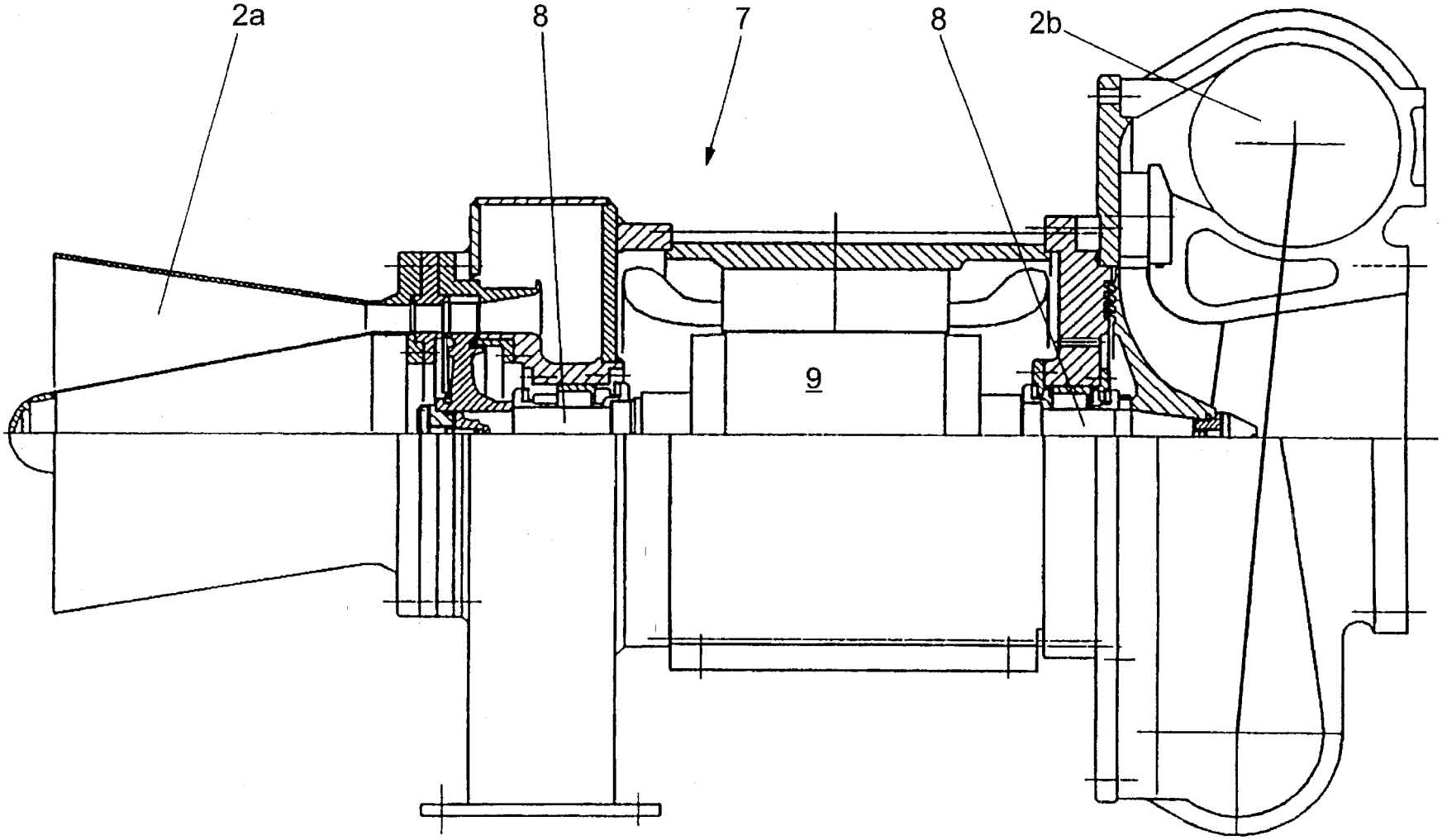
FIG. 3 shows a partial cross-section of an advantageous high-speed machine in a longitudinal direction thereof.

FIG. 3 shows, in a side view, a partial cross-section of an advantageous high-speed machine 7 of a small-size power plant, wherein the first turbine wheel 2*a* of the turbine 2, mounted on the rotor 8 on the first side of generator 9, operates on the axial flow principle, and the second turbine wheel 2*b* mounted on the second side of generator 9 is radially operated. The solution of this kind is very advantageous in practice, whereby in both expansion phases, advantageous turbine wheel constructions are optimally utilized with respect to both manufacturing and operation.

In the advantageous embodiment shown in FIG. 1, the fluid medium to be returned from cooler 3 to vaporizer 1 is arranged to be preheated by a recuperator 6*a* placed in the cycle between turbine 2 and cooler 3.

As a consequence of reheating, the efficiency of the recuperator 6*a* is increased, and the ORC medium is hot upon entering vaporizer 1. Consequently, it is advantageous to arrange the combustion air P to be fed to the burner of vaporizer 1 to be preheated by means of a preheater 10 (Luftvorwärmer). The preheater 10 is formed by a heat exchanger in the vaporizer 1.

In the present embodiment, the feeding device 4 is formed of a separate, preferably hermetic, feeding pump 4*a* and a pre-feeding pump 4*b*, such as an ejector. The pre-feeding pump 4*b* can also be used for developing pressure for the lubrication of bearings. The feeding pump 4*a* can naturally be mounted also on the joint rotor 8 of the high-speed machine 7, in addition to the turbine wheels 2*a*, 2*b*.

Applying conventional calculation techniques, an efficiency rate higher than 30% can be achieved by the apparatus of the operating chart shown in FIG. 1. The efficiency rate has been calculated with the following values:

preheating the combustion air P in the preheater (Luftvorwärmer) 10 from about 20° C. to about 290° C., flue gas S exiting from vaporizer 1: about 100° C., vaporized ORC medium to the first turbine wheel 2*a*: about 382° C./50 bar, ORC medium after the first turbine wheel 2*a*: about 289° C./2 bar, ORC medium after superheater 5 (reheating), to the second turbine wheel 2*b*: about 382° C./2 bar, ORC medium after the second turbine wheel 2*b*: about 310° C., ORC medium after the recuperator 6*a*: about 68° C., and ORC medium returned to vaporizer 1 after the recuperator 6*a*: about 226° C.

The electric power supply of the generator 9 being 100 kW, the net efficiency rate of the apparatus thus obtained is about 32.3%.

As the maximum efficiency rate obtained by conventional small-size power plants is about 20–24% as described above, it is surprising that a significantly better efficiency rate exceeding 30% can be achieved by a small-size power plant utilizing an ORC process with reheating. In spite of reheating, the maximum temperature required of the steam is about 380° C., which is still reasonable. This is because organic cycle media do not sustain very high temperatures; in addition, the valves, pipework etc. needed for high steam temperatures (400° . . . 500° C.) would be too expensive for the small size power plant.

Consequently, a small-size power plant which operates based on the ORC process and is equipped with reheating is well adapted for combustion of a variety of fuels, such as wood chips, gas, oil or the like. The small-size power plant of the invention can be used as a compact and reliable power source supplied by solid fuel, for example in heavy vehicles. Thus for example wood chips can be used as fuel and fed by an automatic burner. In addition, the present invention can be applied for example in deconcentrated energy management in developing countries using local solid fuel.

Figure 2A:
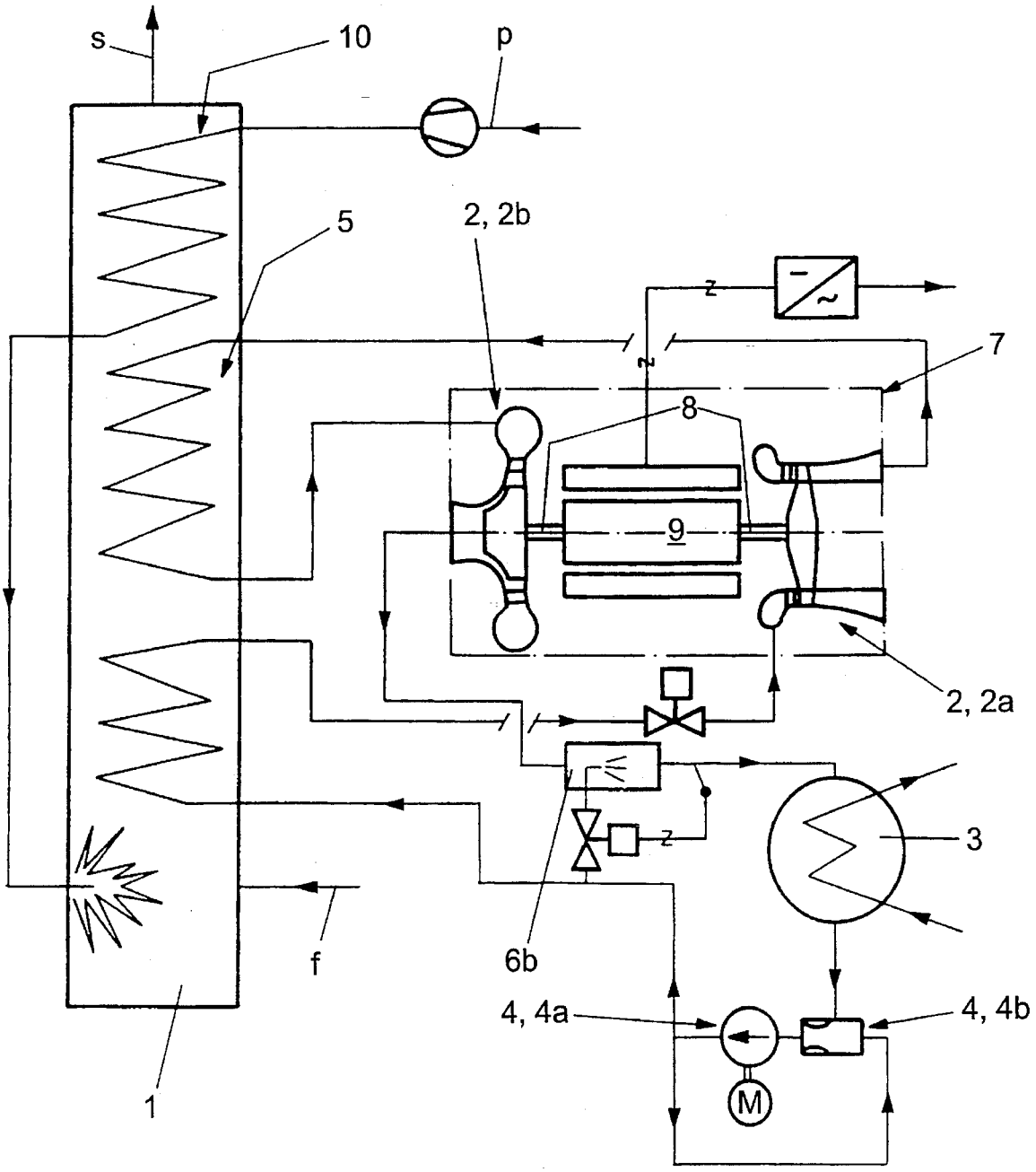
FIGS. 2*a* and 2*b* show advantageous alternative operating charts of apparatuses applying the method of the invention.

Further on the basis of continuous product development, it has proved advantageous to reduce the superheating of the ORC medium by spraying fluid ORC medium to the superheated ORC medium by the intercooler 6*b*, 6*c*. Consequently, as shown in the alternative operating chart shown in FIG. 2*a*, the intercooler 6*b* is used to reduce the superheating of the ORC, medium by spraying fluid ORC medium returned from the cooler 3 to the vaporizer 1 by the feeding device 4 to the at least partially superheated ORC medium passing from the turbine 2 to the cooler 3.

The present invention is suitable for use in apparatuses having no recuperator or employing a low rate of recuperation. Thus, the reduction of the superheating of the used ORC medium, such as toluene vapor, increases the efficiency of the heat transmission surface of the cooler, because the heat transfer coefficient is at least five times smaller with removal of the superheating than with cooling. By spray-cooling toluene vapor into a saturated state, only cooling takes place in the cooler, not removal of the superheating any longer. Due to the high value alpha, a smaller heat transmission surface is sufficient, although the mass flow rate is higher. The lower temperature is naturally advantageous in view of material technology.

Figure 2B:
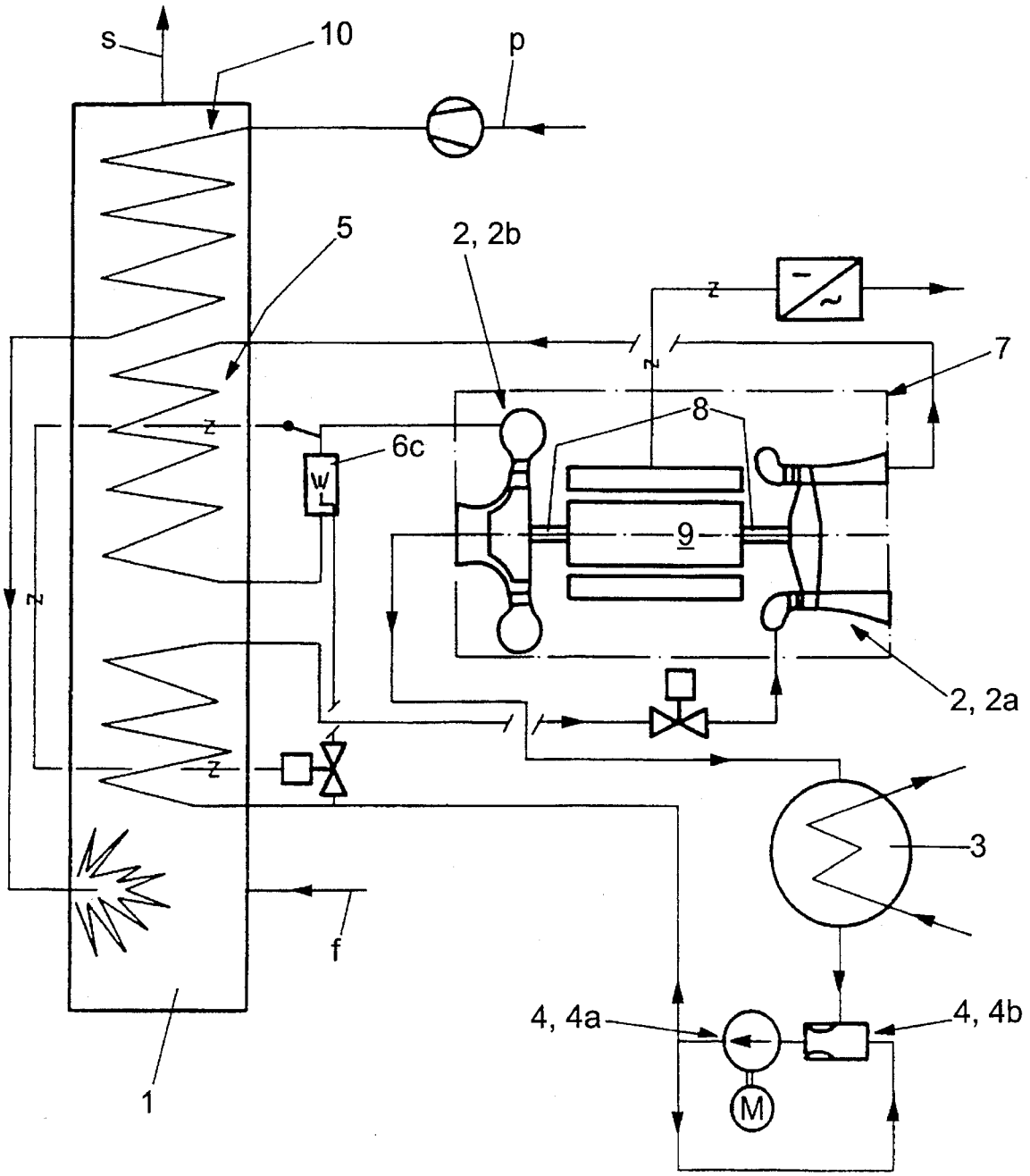

Similarly, FIG. 2*b* shows also an advantageous alternative arrangement, which intercooler 6*c* is used for reducing the superheating of ORC medium by spraying fluid ORC medium returned from cooler 3 to vaporizer 1 by the feeding device 4 to the superheated ORC medium passing from the first turbine wheel 2*a* to the second turbine wheel 2*b*.

This embodiment is advantageous in that the mass flow rate and thus also the efficiency of the turbine is increased by the spraying. Although a fall in the temperature decreases the drop in enthalpy on one hand, it can be shown by calculations that the power output of the turbine may increase as much as 10%. In addition, the degree of superheating of the vapor passing from the turbine 2*b* to the cooler 3 is thus very small, which decreases the heat transmission surface of cooler 3 as described above.

It is obvious that the present invention is not restricted to the embodiments presented above but it can be modified within the basic idea to a great extent, due to the broadscope of the method and the apparatus applying the method. Naturally, for applying the method, it is possible only to intercool the superheated ORC medium without reheating as described above. The superheating apparatus can also contain several phases, in which case a cooling device with one or several phases can be arranged between the phases. By means of a cooling device as described above or an intercooler placed after the superheater as shown in FIG. 2*b*, and by an oversized heat transmission surface of the superheater, it is possible to maintain the temperature of the vapor constant over a large range of loading and simultaneously to prevent overheating of certain parts of the superheater. The cooling device may be either of the spraying or surface type in a known manner. Similarly, the apparatus presented above can be supplemented by conventional for example automatically-operated equipment, such as back-pressure valves, deaerators, and the like.

I claim:

1. A method for improving the efficiency of a small-size power plant based on a closed hermetic organic rankine cycle (ORC) process, the plant including at least one energy converter unit, and at least one burner for combustion of fuel for producing energy for said at least one energy converter unit, wherein the energy converter unit includes a high-speed machine which comprises a first and second turbine and a generator mounted on a common rotor, said method comprising the following steps:

A) supplying a fluid ORC medium to a vaporizer and vaporizing said ORC medium by utilizing the energy derived from the combustion of the fuel in the burner of the vaporizer;

B) expanding the vaporized ORC medium in the first turbine of the high-speed machine of the energy converter to produce electric energy;

C) reheating the ORC medium leaving the first turbine of the high-speed machine by a superheater in the vaporizer by utilizing the energy derived from the combustion of the fuel in the burner of the vaporizer;

D) expanding the reheated ORC medium in the second turbine of the high-speed machine of the energy converter to produce electric energy;

E) leading the ORC medium from the second turbine of the high-speed machine to a cooling arrangement for condensing the same;

F) supplying fluid ORC medium to step A through a pre-heater forming a part of the cooling arrangement wherein said fluid ORC medium is preheated by the ORC medium coming from the second turbine of the high-speed machine; and G) spraying at least partially fluid ORC medium into the reheated ORC medium to reduce reheating of the ORC medium by the superheater.

2. A method according to claim 1, wherein combustion air to be supplied to the burner of the vaporizer, utilizing the energy derived from the combustion of the fuel in the burner of the vaporizer, is preheated by a preheater which is formed of a heat exchanger placed in vaporizer or is connected with the same.

3. A method according to claim 1, wherein the generator is placed between the first and second turbines on the common rotor.

4. A method according to claim 1, wherein the first turbine operates based on an axial principle.

5. A method according to claim 1, wherein the second turbine operates based on a radial principle.

6. A method according to claim 1, wherein the ORC medium is selected from the group comprising fluorinated hydrocarbons and toluenes.

7. A method according to claim 1, wherein the maximum temperature of the ORC medium during the process steps A to F is about 380° C.

8. A method according to claim 1, wherein the cooling arrangement for condensing the ORC medium coming from the second turbine of the high-speed machine further comprises a cooler.

9. A small-size power plant of improved efficiency based on a closed hermetic organic rankine cycle (ORC) process, said power plant comprising:

A) at least one energy converter unit including a first and a second turbine and a generator mounted on a common rotor;

B) at least one burner for the combustion of fuel for producing energy for said at least one energy converter unit;

C) means for supplying a fluid ORC medium to a vaporizer and for vaporizing said ORC medium by utilizing the energy derived from the combustion of fuel in the burner of the vaporizer;

D) means for passing the vaporized ORC medium to the first turbine of the energy converter for expansion therein;

E) means for reheating the ORC medium leaving the first turbine, said means being located in said vaporizer and thereby utilizing the energy derived from the combustion of the fuel in the burner of the vaporizer;

F) means for passing the reheated ORC medium to the second turbine of the energy converter to produce electric energy;

G) means for leading the ORC medium from the second turbine to a cooler for condensing said ORC medium;

H) means for passing the ORC medium from said cooler to said vaporizer;

I) a recuperator placed in the cycle between the said turbines and said cooler to preheat the ORC medium to be returned from said cooler to said vaporizer; and J) means for spraying at least partially fluid ORC medium into the reheated ORC medium such that the reheating of the ORC medium by the superheater is reduced by intercooling.

* * * * *